US006746107B2

(12) United States Patent
Giere et al.

(10) Patent No.: US 6,746,107 B2
(45) Date of Patent: Jun. 8, 2004

(54) INKJET PRINTHEAD HAVING INK FEED CHANNELS DEFINED BY THIN-FILM STRUCTURE AND ORIFICE LAYER

(75) Inventors: Matthew D. Giere, San Diego, CA (US); Colin C. Davis, Corvallis, OR (US); James A. Feinn, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/999,152

(22) Filed: Oct. 31, 2001

(65) Prior Publication Data

US 2003/0081071 A1 May 1, 2003

(51) Int. Cl.[7] ..... B41J 2/05
(52) U.S. Cl. ..... 347/65
(58) Field of Search ..... 347/40, 42, 63, 347/65, 94

(56) References Cited

U.S. PATENT DOCUMENTS

| | | | | |
|---|---|---|---|---|
| 4,463,359 A | | 7/1984 | Ayata et al. | |
| 4,595,935 A | | 6/1986 | Brooks et al. | |
| 4,695,853 A | | 9/1987 | Hackleman et al. | |
| 4,695,854 A | | 9/1987 | Cruz-Uribe | |
| 4,719,477 A | | 1/1988 | Hess | |
| 4,764,659 A | | 8/1988 | Minami et al. | |
| 4,914,562 A | * | 4/1990 | Abe et al. | 347/63 |
| 4,982,199 A | | 1/1991 | Dunn | |
| 4,999,650 A | | 3/1991 | Braun | |
| 5,016,023 A | | 5/1991 | Chan et al. | |
| 5,030,971 A | | 7/1991 | Drake et al. | |
| 5,049,898 A | | 9/1991 | Arthur et al. | |
| 5,103,246 A | | 4/1992 | Dunn | |
| 5,327,165 A | | 7/1994 | Elliott | |
| 5,363,134 A | | 11/1994 | Barbehenn et al. | 347/49 |
| 5,365,312 A | | 11/1994 | Hillmann et al. | 355/206 |
| 5,371,530 A | | 12/1994 | Hawkins et al. | 347/9 |
| 5,412,410 A | | 5/1995 | Rezanka | |
| 5,534,895 A | | 7/1996 | Lindenfelser et al. | |
| 5,541,629 A | | 7/1996 | Saunders et al. | 347/12 |
| 5,604,513 A | | 2/1997 | Takahashi et al. | 345/153 |
| 5,610,635 A | | 3/1997 | Murray et al. | 347/7 |
| 5,638,101 A | * | 6/1997 | Keefe et al. | 347/65 |
| 5,646,660 A | | 7/1997 | Murray | 347/59 |
| 5,648,804 A | | 7/1997 | Keefe et al. | 347/47 |
| 5,648,806 A | | 7/1997 | Steinfield et al. | |
| 5,666,140 A | | 9/1997 | Mitani et al. | |
| 5,697,144 A | | 12/1997 | Mitani et al. | |
| 5,742,305 A | | 4/1998 | Hackleman | |
| 5,815,172 A | | 9/1998 | Moh | 347/14 |
| 5,815,180 A | | 9/1998 | Barbour et al. | 347/59 |
| 5,859,655 A | * | 1/1999 | Gelorme et al. | 347/65 |

(List continued on next page.)

FOREIGN PATENT DOCUMENTS

| | | | |
|---|---|---|---|
| EP | 0547921 B1 | 6/1993 | B41J/2/175 |
| EP | 0 913 257 | 5/1999 | |
| EP | 1078753 A2 | 2/2001 | |
| JP | 08216435 * | 8/1996 | |

OTHER PUBLICATIONS

A copy of European Search Report for Application No. EP 02 25 7312 mailed on Jul. 30, 2003 (4 pages).

*Primary Examiner*—Michael Brooke

(57) ABSTRACT

An inkjet printhead includes a substrate having an ink feed slot formed therein. The inkjet printhead includes drop generators and ink feed channels. Each drop generator has a nozzle and a vaporization chamber. At least one ink feed channel is fluidically coupled to each vaporization chamber and is fluidically coupled to the ink feed slot. A thin-film structure is supported by the substrate and defines a first portion of each ink feed channel. An orifice layer supported by the substrate defines the nozzles and the vaporization chambers in the drop generators. The orifice layer defines a second portion of each ink feed channel.

41 Claims, 9 Drawing Sheets

U.S. PATENT DOCUMENTS 5,877,791 A * 3/1999 Lee et al. ..... 347/63
5,886,718 A 3/1999 Johnson et al. ..... 347/85
5,946,012 A 8/1999 Courian et al. ..... 347/63
5,984,455 A 11/1999 Anderson
6,000,787 A * 12/1999 Weber et al. ..... 347/65
6,091,891 A 7/2000 Overall et al. ..... 395/112
6,109,716 A 8/2000 Takahashi ..... 347/11
6,126,261 A 10/2000 Yamanaka ..... 347/12
6,139,131 A 10/2000 Prasad et al.
6,178,009 B1 1/2001 Yamada et al. ..... 358/1.9
6,186,616 B1 * 2/2001 Inoue et al. ..... 347/45
6,193,345 B1 2/2001 Feinn et al. ..... 347/12
6,508,538 B2 * 1/2003 Suzuki et al. ..... 347/43

* cited by examiner

INKJET PRINTHEAD HAVING INK FEED CHANNELS DEFINED BY THIN-FILM STRUCTURE AND ORIFICE LAYER

CROSS-REFERENCE TO RELATED APPLICATIONS

This Non-Provisional Patent Application is related to the following commonly assigned U.S. patent applications: Ser. No. 09/798,330, now U.S. Pat. No. 6,478,396, filed on Mar. 20, 2001, entitled "PROGRAMMABLE NOZZLE FIRING ORDER FOR INKJET PRINTHEAD ASSEMBLY"; Ser. No. 09/876,470, now U.S. Pat. No. 6,561,632, filed on Jun. 6, 2001, entitled "PRINTHEAD WITH HIGH NOZZLE PACKING DENSITY"; Ser. No. 09/876,506 filed on Jun. 6, 2001, entitled "BARRIER/ORIFICE DESIGN FOR IMPROVED PRINTHEAD PERFORMANCE"; Ser. No. 09/999,355 filed on Oct. 31, 2001, entitled "INKJET PRINTHEAD ASSEMBLY HAVING VERY HIGH DROP RATE GENERATION"; Ser. No. 09/999,354, now U.S. Pat. No. 6,543,879 filed on Oct. 31, 2001, entitled "INKJET PRINTHEAD ASSEBMLY HAVING VERY HIGH NOZZLE PACKING DENSITY", all of which are herein incorporated by reference.

THE FIELD OF THE INVENTION

The present invention relates generally to inkjet printheads, and more particularly to inkjet printheads having very high nozzle packing densities.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

Typically, the printhead ejects the ink drops through the nozzles by rapidly heating a small volume of ink located in vaporization chambers with small electric heaters, such as thin film resisters. Heating the ink causes the ink to vaporize and be ejected from the nozzles. Typically, for one dot of ink, a remote printhead controller typically located as part of the processing electronics of a printer, controls activation of an electrical current from a power supply external to the printhead. The electrical current is passed through a selected thin film resister to heat the ink in a corresponding selected vaporization chamber. The thin film resistors are herein also referred to as firing resistors. A drop generator is herein referred to include a nozzle, a vaporization chamber, and a firing resistor.

The number of nozzles disposed in a given area of the printhead die is referred to as nozzle packing density. Current inkjet printhead technology has allowed the nozzle packing density to reach approximately 20 nozzles per square millimeter ($mm^2$). Nevertheless, there is a desire for much higher nozzle packing densities to accommodate high printing resolutions and enable increased number of drop generators per printhead to also thereby improve printhead drop generation rate.

For reasons stated above and for other reasons presented in greater detail in the Description of the Preferred Embodiments section of the present specification, an inkjet printhead is desired which has a very high nozzle packing density to permit a very high number of drop generators on the inkjet printhead.

SUMMARY OF THE INVENTION

One aspect of the present invention provides an inkjet printhead including a substrate having an ink feed slot formed in the substrate. The inkjet printhead includes drop generators and ink feed channels. Each drop generator has a nozzle and a vaporization chamber. At least one ink feed channel is fluidically coupled to each vaporization chamber and is fluidically coupled to the ink feed slot. A thin-film structure is supported by the substrate and defines a first portion of each ink feed channel. An orifice layer supported by the substrate defines the nozzles and the vaporization chambers in the drop generators. The orifice layer defines a second portion of each ink feed channel.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
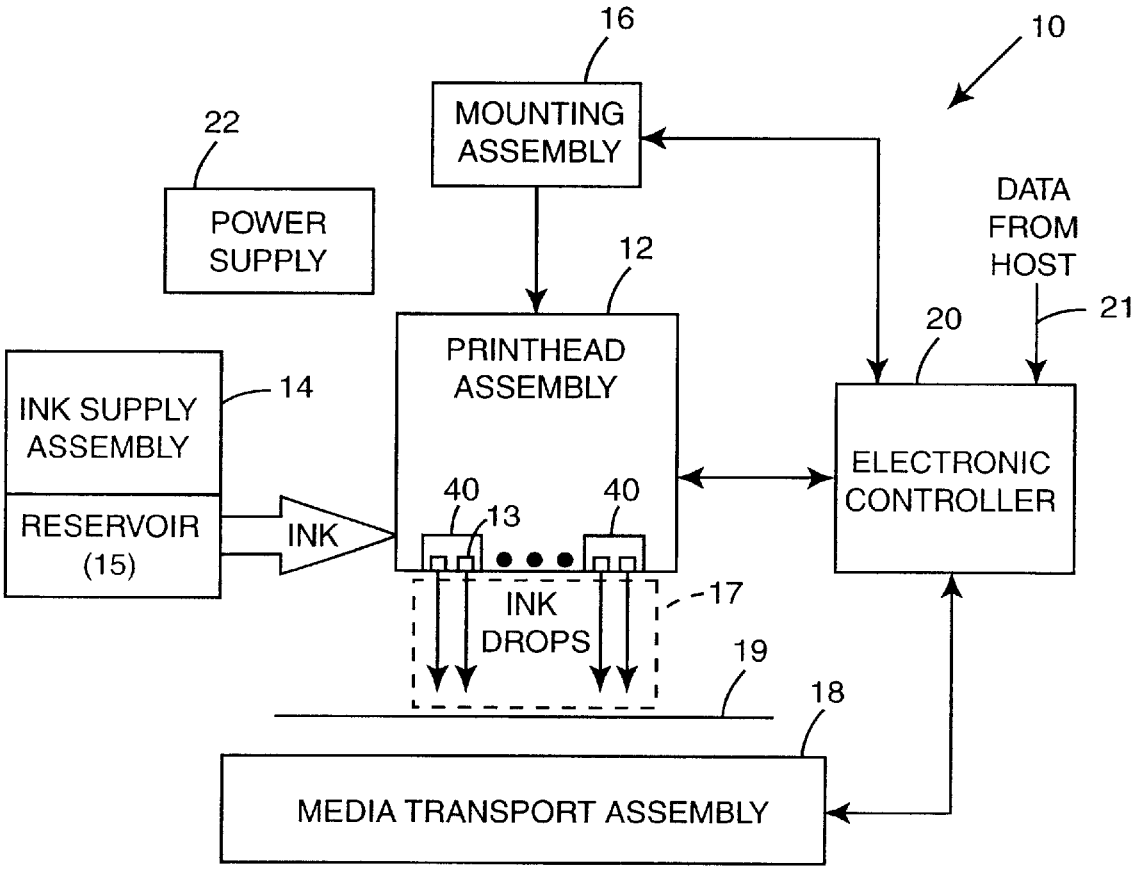
FIG. 1 is a block diagram illustrating one embodiment of an inkjet printing system.

FIG. 1 illustrates one embodiment of an inkjet printing system 10. Inkjet printing system 10 includes an inkjet printhead assembly 12, an ink supply assembly 14, a mounting assembly 16, a media transport assembly 18, and an electronic controller 20. At least one power supply 22 provides power to the various electrical components of inkjet printing system 10. Inkjet printhead assembly 12 includes at least one printhead or printhead die 40 which ejects drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical, or other information transfer path. Data 21 represents, for example, a document and/or file to be printed. As such, data 21 forms a print job for inkjet printing system 10 and includes one or more print job commands and/or command parameters.

In one embodiment, electronic controller 20 controls inkjet printhead assembly 12 for ejection of ink drops from nozzles 13. As such, electronic controller 20 defines a pattern of ejected ink drops which form characters, symbols, and/or other graphics or images on print medium 19. The pattern of ejected ink drops is determined by the print job commands and/or command parameters.

In one embodiment, inkjet printhead assembly 12 includes one printhead 40. In another embodiment, inkjet printhead assembly 12 is a wide-array or multi-head printhead assembly. In one wide-array embodiment, inkjet printhead assembly 12 includes a carrier, which carries printhead dies 40, provides electrical communication between printhead dies 40 and electronic controller 20, and provides fluidic communication between printhead dies 40 and ink supply assembly 14.

Figure 2:
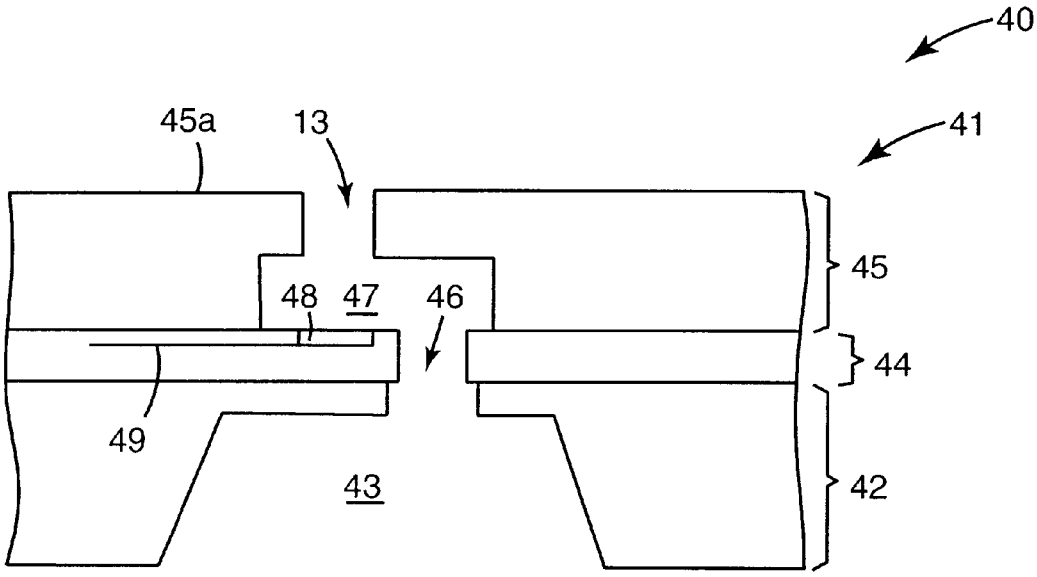
FIG. 2 is an enlarged schematic cross-sectional view illustrating portions of one embodiment of a printhead die.

A portion of one embodiment of a printhead die 40 is illustrated schematically in FIG. 2. Printhead die 40 includes an array of printing or drop ejecting elements (i.e., drop generators) 41. Printing elements 41 are formed on a substrate 42 which has an ink feed slot 43 formed therein. As such, ink feed slot 43 provides a supply of liquid ink to printing elements 41. Each printing element 41 includes a thin-film structure 44, an orifice layer 45, and a firing resistor 48. Thin-film structure 44 has an ink feed channel 46 formed therein which communicates with ink feed slot 43 formed in substrate 42. Orifice layer 45 has a front face 45*a* and a nozzle opening 13 formed in front face 45*a*. Orifice layer 45 also has a nozzle chamber or vaporization chamber 47 formed therein which communicates with nozzle opening 13 and ink feed channel 46 of thin-film structure 44. Firing resistor 48 is positioned within nozzle chamber 47. Leads 49 electrically couple firing resistor 48 to circuitry controlling the application of electrical current through selected firing resistors.

During printing, ink flows from ink feed slot 43 to nozzle chamber 47 via ink feed channel 46. Nozzle opening 13 is operatively associated with firing resistor 48 such that droplets of ink within nozzle chamber 47 are ejected through nozzle opening 13 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 42 is formed, for example, of silicon, glass, or a stable polymer and thin-film structure 44 is formed by one or more passivation or insulation layers of silicon dioxide, silicon carbide, silicon nitride, tantalum, poly-silicon glass, or other suitable material. Thin-film structure 44 also includes a conductive layer which defines firing resistor 48 and leads 49. The conductive layer is formed, for example, by aluminum, gold, tantalum, tantalum-aluminum, or other metal or metal alloy.

In one embodiment, orifice layer 45 is fabricated using a spun-on epoxy referred to as SU8, marketed by Micor-Chem, Newton, Mass. Exemplary techniques for fabricating orifice layer 45 with SU8 or other polymers are described in detail in U.S. Pat. No. 6,162,589, which is herein incorporated by reference. In one embodiment, orifice layer 45 is formed of two separate layers referred to as a barrier layer (e.g., a dry film photo resist barrier layer) and a metal orifice layer (e.g., a nickel/gold orifice plate) formed on an outer surface of the barrier layer.

Printhead assembly 12 can include any suitable number (P) of printheads 40, where P is at least one. Before a print operation can be performed, data must be sent to printhead 40. Data includes, for example, print data and non-print data for printhead 40. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification.

Figure 3:
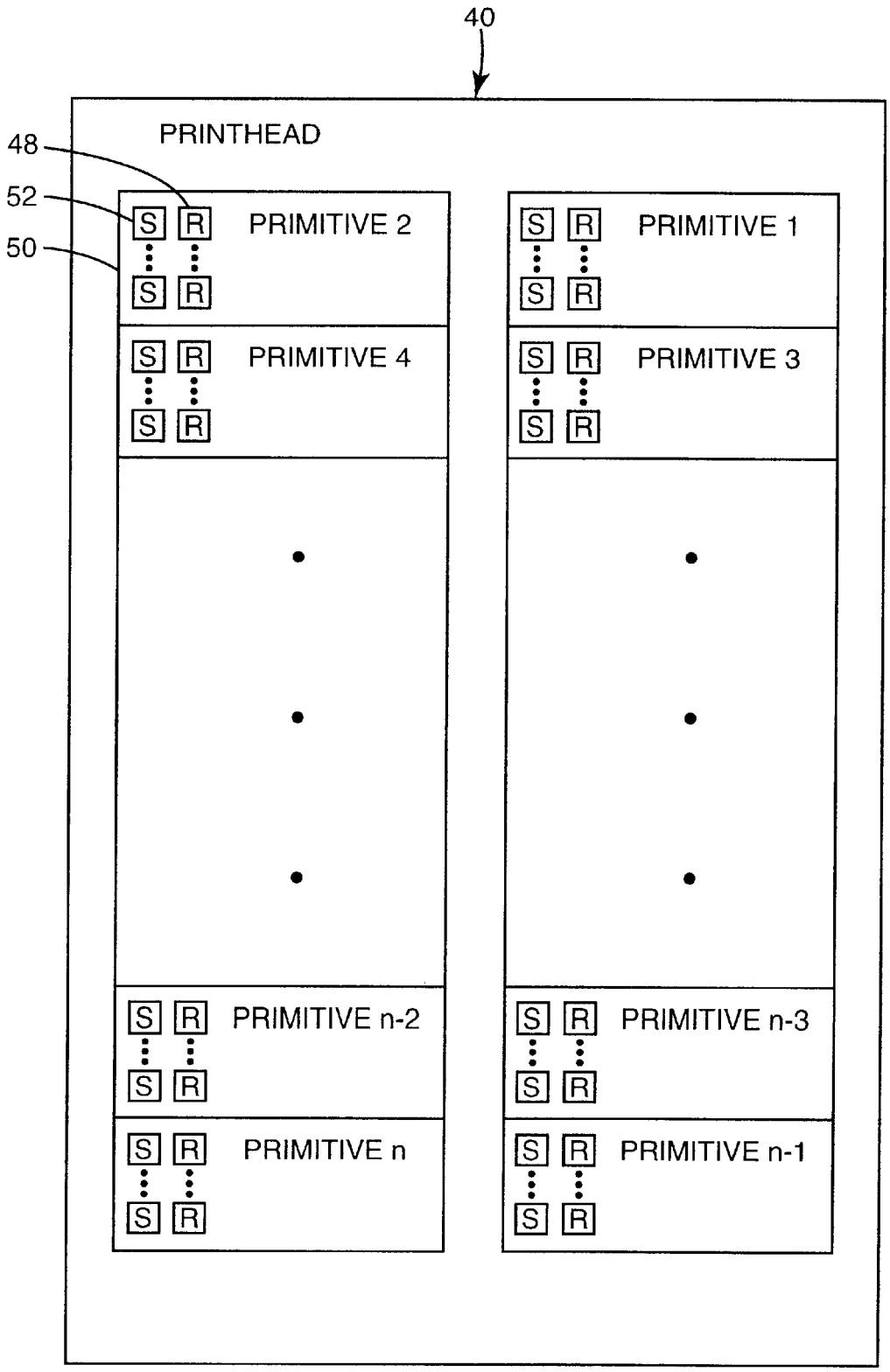
FIG. 3 is a block diagram illustrating portions of one embodiment of an inkjet printhead having firing resistors grouped together into primitives.

One embodiment of printhead 40 is illustrated generally in block diagram form in FIG. 3. Printhead 40 includes multiple firing resistors 48 which are grouped together into primitives 50. As illustrated in FIG. 3, printhead 40 includes N primitives 50. The number of firing resistors 48 grouped in a given primitive can vary from primitive to primitive or can be the same for each primitive in printhead 40. Each firing resistor 48 has an associated switching device 52, such as a field effect transistor (FET). A single power lead provides power to the source or drain of each FET 52 for each resistor in each primitive 50. Each FET 52 in a primitive 50 is controlled with a separately energizable address lead coupled to the gate of the FET 52. Each address lead is shared by multiple primitives 50. The address leads are controlled so that only one FET 52 is switched on at a given time so that only a single firing resistor 48 has electrical current passed through it to heat the ink in a corresponding selected vaporization chamber at the given time.

In the embodiment illustrated in FIG. 3, primitives 50 are arranged in printhead 40 in two columns of N/2 primitives per column. Other embodiments of printhead 40, however, have primitives arranged in many other suitable arrangements. An example primitive arrangement which permits a very high nozzle packing density is described below with reference to FIG. 6.

Figure 4:
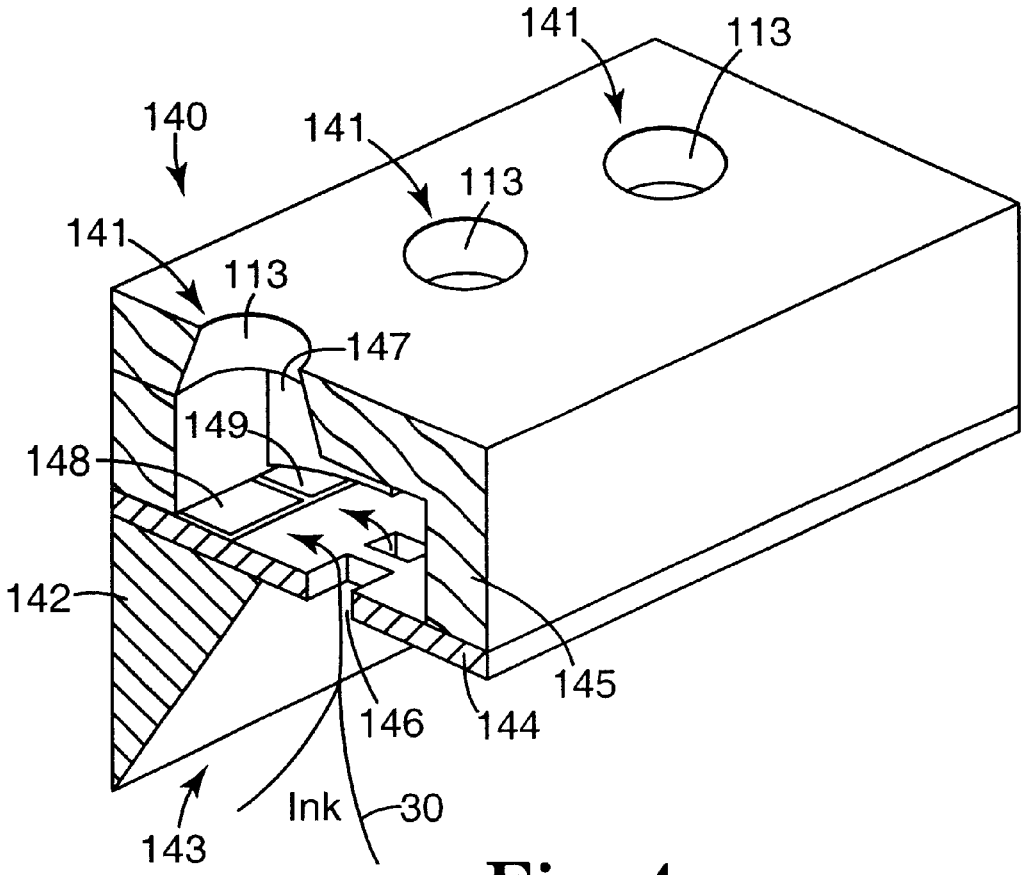
FIG. 4 is a cross-sectional perspective view of one embodiment of portions of a printhead die.

A portion of one embodiment of a printhead die 140 is illustrated in a cross-sectional perspective view in FIG. 4. Printhead die 140 includes an array of drop ejection elements or drop generators 141. Drop generators 141 are formed on a substrate 142 which has an ink feed slot 143 formed therein. Ink feed slot 143 provides a supply of ink to drop generators 141. Printhead die 140 includes a thin-film structure 144 on top of substrate 142. Printhead die 140 includes an orifice layer 145 on top of thin-film structure 144.

Each drop generator 141 includes a nozzle 113, a vaporization chamber 147, and a firing resistor 148. Thin-film structure 144 has an ink feed channel 146 formed therein which communicates with ink feed slot 143 formed in substrate 142. Orifice layer 145 has nozzles 113 formed therein. Orifice layer 145 also has vaporization chamber 147 formed therein which communicates with nozzles 113 and ink feed channel 146 formed in thin-film structure 144. Firing resistor 148 is positioned within vaporization chamber 147. Leads 149 electrically couple firing resistor 148 to circuitry controlling the application of electrical current through selected firing resistors.

During printing, ink 30 flows from ink feed slot 143 to nozzle chamber 147 via ink feed channel 146. Each nozzle 113 is operatively associated with a corresponding firing resistor 148, such that droplets of ink within vaporization chamber 147 are ejected through the selected nozzle 113 (e.g., normal to the plane of the corresponding firing resistor 148) and toward a print medium upon energization of the selected firing resistor 148.

An example printhead 140 typically includes a large number of drop generators 141 (e.g., 400 or more drop generators). One example embodiment of printhead 140 has very high nozzle packing density which enables printhead 140 to eject ink drops at a very high drop rate generation. For example, one example embodiment of printhead 140 is approximately ½ inch long and contains four offset columns of nozzles, each column containing 304 nozzles for a total of 1,216 nozzles per printhead 140. In another example embodiment, each printhead 140 is approximately one inch long and contains four offset columns of nozzles 113, each column containing 528 nozzles for a total of 2,112 nozzles per printhead. In both of these example embodiments, the nozzles 113 in each column have a pitch of 600 dots per inch (dpi), and the columns are staggered to provide a printing resolution, using all four columns, of 2400 dpi. These embodiments of printhead 140 can print at a single pass resolution of 2400 dpi along the direction of the nozzle columns or print at a greater resolution in multiple passes. Greater resolutions may also be printed along the scan direction of the printhead 140.

Thin-film structure 144 is also herein referred to as a thin-film membrane 144. In one example embodiment, containing four offset columns of nozzles, two columns are formed on one thin-film membrane 144 and two columns are formed on another thin-film membrane 144.

Figure 5:
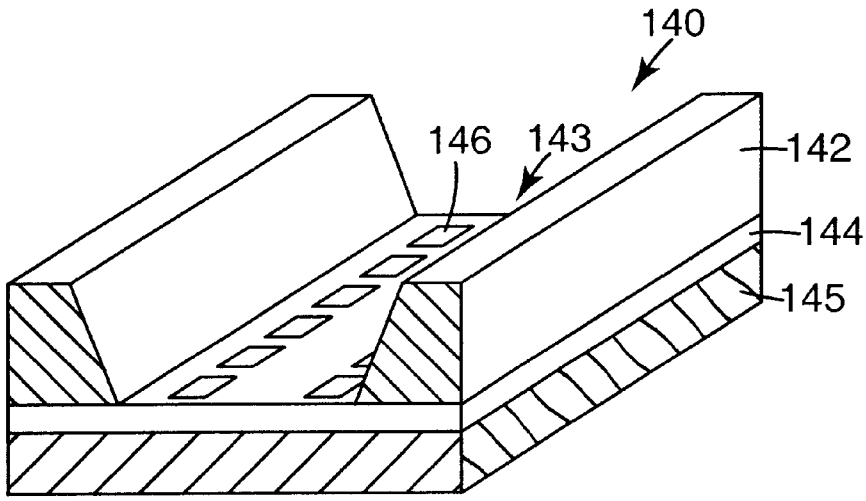
FIG. 5 is a cross-sectional perspective underside view of one embodiment of the printhead die of FIG. 5.

A perspective underside view of printhead 140 is illustrated generally in FIG. 5. As illustrated in FIG. 5, a single ink feed slot 143 provides access to two columns of ink feed channels 146. In one embodiment, the size of each ink feed channel 146 is smaller than the size of a nozzle 113 so that particles in ink 30 are filtered by ink feed channels 146 and do not clog nozzles 113. The clogging of an ink feed channel 146 has little effect on the refill speed of a vaporization chamber 147, because multiple ink feed channels 146 supply ink 30 to each vaporization chamber 147. Accordingly, in one embodiment, there are more ink feed channels 146 than ink vaporization chambers 147.

Figure 9:
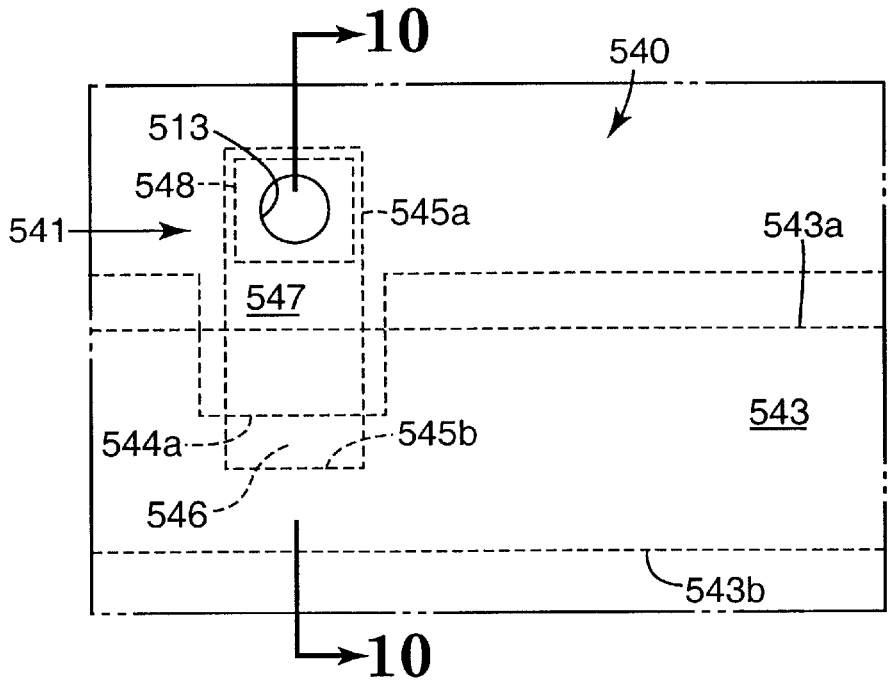
FIG. 9 is an enlarged top schematic view of a portion of one embodiment a printhead.
Figure 10:
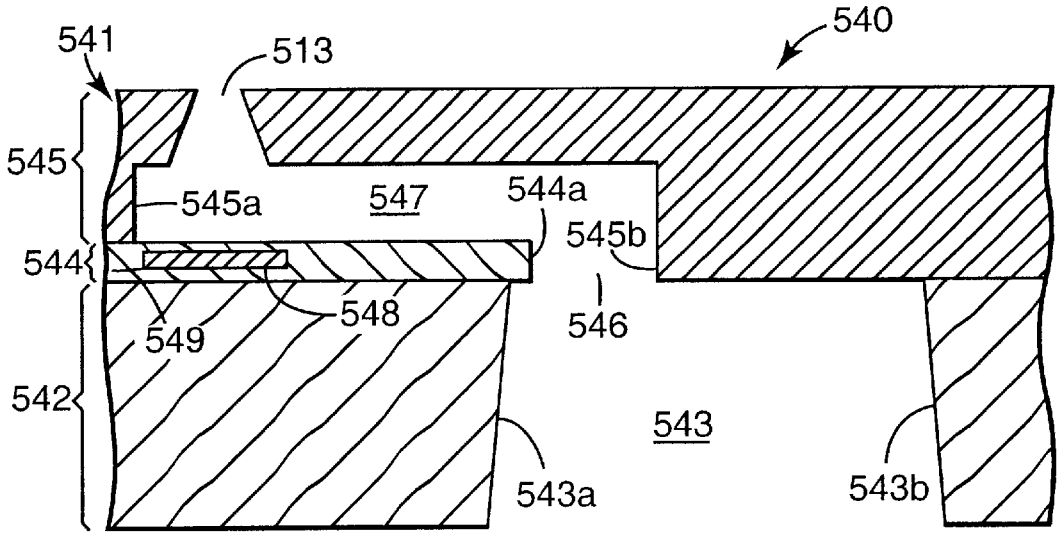
FIG. 10 is an enlarged schematic cross-sectional view of the printhead of FIG. 9 taken along lines 10—10.
Figure 11:
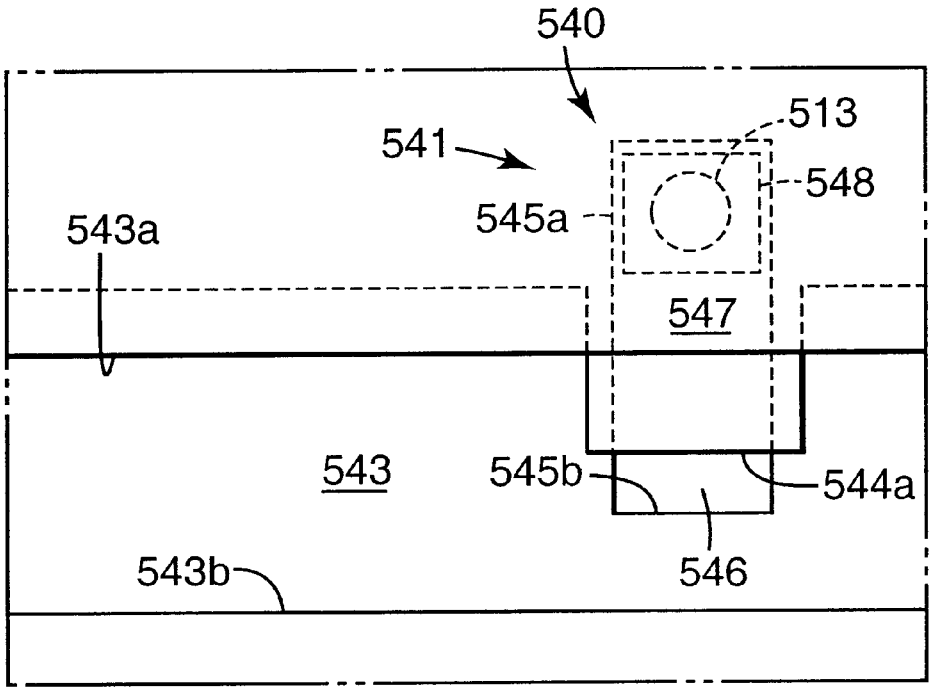
FIG. 11 is an enlarged underside schematic view of the printhead of FIGS. 9 and 10.

Uniform ink feed slot 143 permits nozzles 113 to be formed relatively close to the ink feed slot. In one embodiment illustrated in FIGS. 4 and 5, ink feed slot 143 is formed in substrate 142 by wet etching the silicon substrate 142. In another embodiment not illustrated in FIGS. 4 and 5, ink feed slot 143 is formed in substrate 142 by dry etching silicon substrate 142, such a similar dry etched embodiment is illustrated in FIGS. 9–11. Wet etching relies on selectivity between silicon crystal planes and typically follows a silicon crystal plane at an approximately 54 degree angle from the bottom surface of silicon substrate 142 to thereby form approximately 54 degree trench walls in ink feed slot 143. By contrast, dry etching does not rely on selectivity between silicon crystal planes, and therefore, does not follow a particular silicon crystal plane which enables substantially straight trench walls in ink feed slot 143 to be formed with dry etching. In one example embodiment, dry etching forms approximately 85 degree trench walls in ink feed slot 143 from the bottom surface of silicon substrate 142.

Therefore, since dry etching does not rely on selectivity between silicon crystal planes, dry etching requires less area to fabricate ink feed slot 143 which facilitates very high nozzle packing density printheads by allowing ink feed slots to be placed relatively close together and be relatively narrow in width (e.g., 80 microns or narrower). In addition, an example wet etch process takes approximately 10 hours to form ink feed slot 143 which can substantially degrade the adhesion between orifice layer 145 and thin-film structure 144. By contrast, an example dry etching process takes approximately 3 hours to form ink feed slot 143 which causes substantially less degradation of the adhesion between orifice layer 145 and thin-film structure 144. As a result, yields of very high nozzle packing density printheads can be improved with dry etching.

A typical ink feed slot etch process to form the ink feed slot is inherently difficult to control with great precision. Typically, a higher minimum distance across the ink feed slot provides more margin in the process to improve manufacturability and yield. In addition, the thin-film resistors must not be undercut during the etching of the ink feed slot to ensure that sufficient silicon from the substrate is underneath the thin-film resistors to ensure that the resistors do not overheat.

Figure 6:
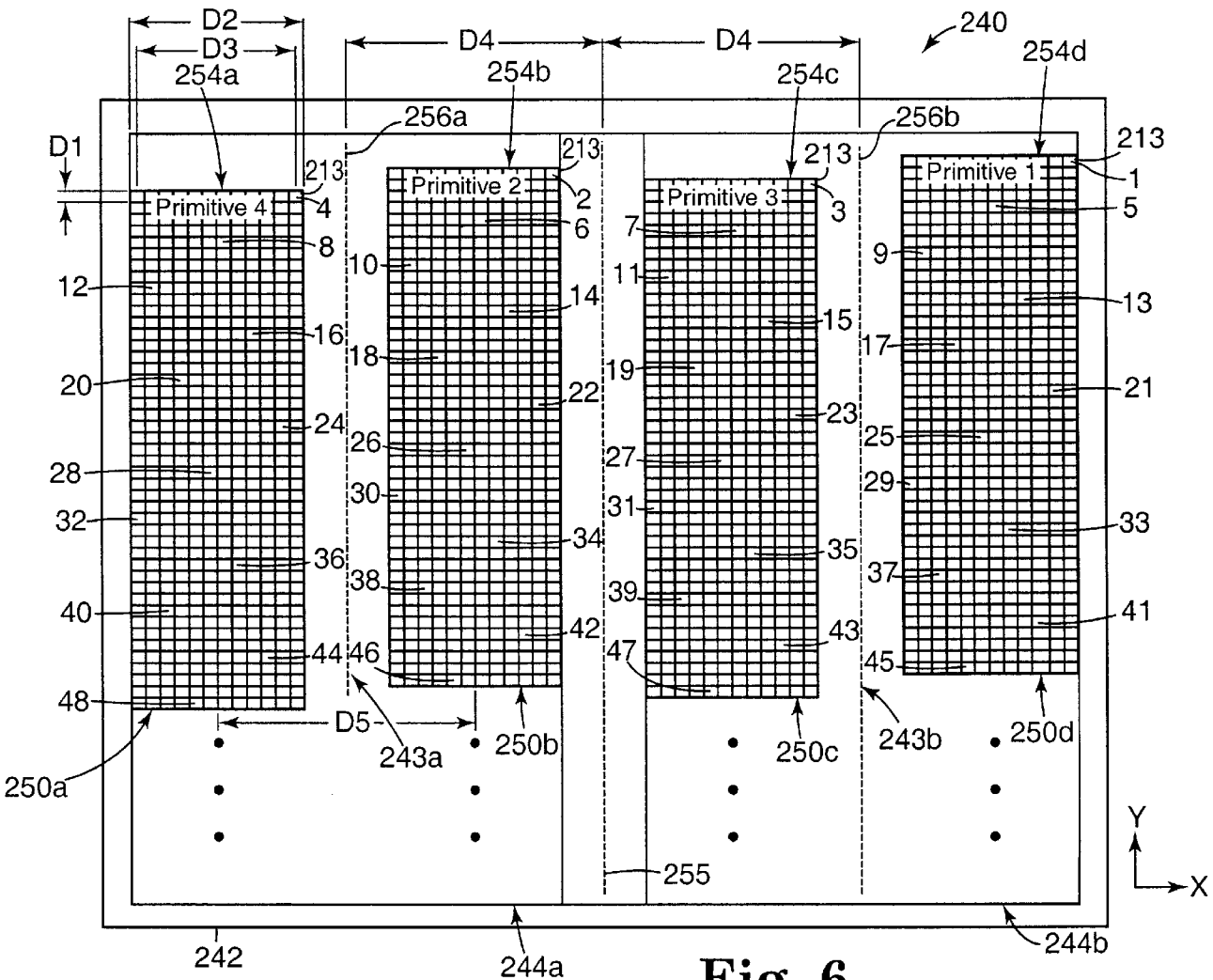
FIG. 6 is a diagramic view of a printhead die nozzle and primitive layout for a printhead with a very high nozzle packing density.

A portion of one embodiment of a printhead die 240 is illustrated in diagram form in FIG. 6. Printhead die 240 includes two thin-film membranes 244*a* and 244*b* formed on a single printhead die substrate 242. Nozzle columns 254*a* and 254*b* are formed on thin-film membrane 244*a*. Nozzle columns 254*c* and 254*d* are formed on thin-film membrane 244*b*. Nozzle columns 254*a*–254*d* are offset to enable very high nozzle densities. In one example embodiment, nozzles columns 254*a*–254*d* are offset in a vertical direction to create a nozzle spacing of all nozzles in the four nozzle columns of 2400 nozzles per inch (npi).

Each nozzle column 254 includes N/4 number of primitives 250, but FIG. 6 illustrates only one primitive 250 for each column 254 (e.g., nozzle column 254*a* includes primitive 250*a*, nozzle column 254*b* includes primitive 250*b*, nozzle column 254*c* includes primitive 250*c*, and nozzle column 254*d* includes primitive 250*d*). Since there are N/4 primitives 250 in each nozzle column 254, there are N primitives in printhead die 240. In one example embodiment, N is equal to 176 resulting in 44 primitives per nozzle column 254, 88 primitives on each thin-film membrane 244, and 176 primitives on printhead die 240.

The nozzle address has M address values. Each primitive 250 includes M' nozzles 213, wherein M' is at most M and M' can possibly vary from primitive to primitive. In the illustrated embodiment, each primitive 250 includes 12 nozzles. Thus, 12 nozzle address values are required to address all 12 nozzles within a primitive 250. The nozzle address is cycled through all M nozzle address values to control the nozzle firing order so that all nozzles can be fired, but only a single nozzle in a primitive 250 is fired at a given time.

The example nozzle layout of example printhead die 240 has a total primitive to address ratio of N/M=176/12= approximately 14.7. In addition, each nozzle column 254 contains 44×12 nozzles=528 nozzles resulting in 4×528=2, 112 total nozzles in printhead die 240. In another example embodiment, such as disclosed in the above-incorporated Patent Application entitled "PRINTHEAD WITH HIGH NOZZLE PACKING DENSITY," each nozzle column contains 38 primitives for a total of 152 primitives, and each primitive contains eight nozzles for a total of 304 nozzles in each nozzle column and a total of 1,216 nozzles per printhead. In this second example embodiment, eight addresses are required to address all nozzles resulting in a primitive to address ratio N/M=152/8=19 for the printhead die. The very high nozzle packing density achieved with these example printhead nozzle layouts enables these high primitive to address ratios to enable very high drop rate generation.

In FIG. 6, the printhead die 240 nozzle layout is not illustrated to scale, but rather, is illustrative of how the four nozzle columns 254 are staggered relative to each other and how a skip pattern operates. Other embodiments of printhead 240 have other suitable numbers of staggered nozzle columns 254 (e.g., 2, 6, 8, etc.). Each nozzle column 254 has a width dimension, indicated by distance arrows D2, along a horizontal or X-axis, which is 1/1200 inch in an example embodiment. The 12 nozzles in each primitive are staggered along the X-axis. The total amount of stagger within a primitive 250 is represented by distance arrows D3, which in the example embodiment is approximately 19.4 microns or micrometers ($\mu$m). The total stagger within a primitive 250 represented by arrows D3 is measured from the innermost firing resistor to the outermost firing resistor and is also referred to as the total scan axis stagger. For example, in primitive 250*a* the total scan axis stagger is measured from firing resistor 4 to firing resistor 32 along the X-axis. Along the scan axis, the horizontal resolution is determined by carriage speed and firing frequency, not physical nozzle location (e.g., 2400 dpi along the scan axis could be achieved with a 20 inch per second (ips) carriage speed and a firing frequency of 48 Khz.) The example 1/1200 inch distance D2 represents an optimization for 1200 dpi printing.

Each diagramic cell representing placement of nozzles in FIG. 6 has a distance, represented by arrows D1, along a vertical (Y) axis, which is 1/2400 inch in an example embodiment. Each diagramic cell is not illustrated to scale along the horizontal (X) axis. The nozzles of nozzle column 254*a* are offset along the Y-axis by 1/1200 inch relative to the nozzles of nozzle column 254*b* on thin-film membrane 244*a*. Similarly, the nozzles of nozzle column 254*c* are offset by 1/1200 inch along the Y-axis relative to the nozzles of nozzle column 254*d* on thin-film membrane 244*b*. In addition, the nozzles of nozzle columns 254*a* and 254*b* are offset along the Y-axis by 1/2400 inch from the nozzles of nozzle columns 254*c* and 254*d*. As a result, the primitive stagger pattern in the vertical direction along the Y-axis creates a nozzle spacing of all nozzles in the four nozzle columns 254*a*–254*d* of 2400 npi along the Y-axis.

The two thin-film membranes 244*a* and 244*b* are disposed about a center axis, indicated at 255, of substrate 242 of printhead 240. Ink is fed to the drop generators through trenches formed in substrate 242 referred to as left ink feed slot 243*a* and right ink feed slot 243*b*. The physical structure of such an ink slot is indicated at 143 in FIGS. 4 and 5 and described above. The drop generators of nozzle column 254*a* and 254*b* are fed ink by left ink feed slot 243*a* having a center along line 256*a*. The drop generators of nozzle columns 254*c* and 254*d* are fed ink from right ink feed slot 243*b* having a center along line 256*b*. A distance, represented by arrows D4, is indicated from the center of substrate 242 to the center of each ink feed slot 243 (i.e., between center line 255 and 256*a* and between center line 255 and center line 256*b*). In the example embodiment of printhead 240, distance D4 is approximately 899.6 $\mu$m. A column spacing distance on each thin-filmed membrane 244 is indicated by arrows D5 and represents the horizontal distance along the X-axis from the center of the primitive 250 on the left of an ink feed slot 243 to the center of the primitive 250 on the right of the ink feed slot 243. In one example embodiment, the column spacing distance D5 is approximately 169.3 $\mu$m.

All of the above distances D1–D5 are implementation dependent and very based on specific parameters and design choices, and the above example values represent suitable values for one exemplary implementation of printhead die 240.

In one example embodiment, where the column spacing distance D5 is approximately 169.3 μm and the nozzle column 254 width indicated by D2 is 1/1200 inch or approximately 21.2 μm, the total width across nozzle column 254*a*, ink feed slot 243*a*, and nozzle column 254*b* is approximately 0.1905 (mm). In this embodiment, where distance D1 along the vertical Y axis is 1/2400 inch or approximately 10.6 μm and the nozzles of nozzle column 254*a* are offset along the Y axis by 1/1200 inch or approximately 21.2 μm relative to the nozzles of nozzle column 254*b*, the nozzle packing density for the nozzles in nozzle columns 254*a* and 254*b* along ink feed slot 243*a* including the area of ink feed slot 243*a* is approximately 250 nozzles/mm$^2$. As discussed in the Background of the Invention section of the present specification, conventional inkjet printhead technology has allowed the nozzle packing density for nozzles fed from one ink feed slot including the area of the ink feed slot to only reach approximately 20 nozzles/mm$^2$ compared with the approximately 250 nozzles/mm$^2$ achieved in the example embodiment.

In the embodiment of printhead die 240 illustrated in FIG. 6, primitive 250*d* is referred to as primitive 1 and includes resistors 1, 5, 9, 13, 17, 21, 25, 29, 33, 37, 41, and 45. Primitive 250*b* is referred to as primitive 2 and includes resistors 2, 6, 10, 14, 18, 22, 26, 30, 34, 38, 42, and 46. Primitive 250*c* is referred to as primitive 3 and includes resistors 3, 7, 11, 15, 19, 23, 27, 31, 35, 39, 43, and 47. Primitive 250*a* is referred to as primitive 4 and includes resistors 4, 8, 12, 16, 20, 24, 28, 32, 36, 40, 44, and 48. This example resistor numbering and primitive numbering is herein referred to as a standard orientation representing printhead die 240 with the nozzles 213 facing the viewer with resistor 1 at the top of printhead die 240. Thus, in this standard orientation, as to the primitives 250 adjacent to right ink feed slot 243*b*, the top right primitive is primitive 1, the top left primitive is primitive 3, the bottom right primitive is 173, and the bottom left primitive is primitive 175. As to the primitives 250 adjacent to left ink feed slot 243*a*, the top right primitive is primitive 2, the top left primitive is primitive 4, the bottom right primitive is primitive 174, and the bottom left primitive is primitive 176.

The firing resistor numbering is such that the top firing resistor for the firing resistors adjacent to right ink feed slot 243*b* is resistor 1, while the bottom firing resistor adjacent to right ink feed slot 243*b* is resistor 2111. As to the firing resistors adjacent to left ink feed slot 243*a*, the top firing resistor is resistor 2, while the bottom firing resistor is resistor 2112. The firing resistors are disposed on each edge of an ink feed slot 243 at a vertical spacing of 1/600 inch along the Y-axis. As discussed above, the firing resistors on the left side of each ink feed slot 243 are offset from the firing resistors on the right side of the same ink feed slot 243 by 1/1200 inch. All of the firing resistors adjacent to the left ink feed slot 243*a* are offset by 1/2400 inch with respect to the firing resistors adjacent to the right ink feed slot 243*b*. In an example printing operation by printhead 240, the position of ink dots in a vertical line printed from top to bottom corresponds to the number of the firing resistor which fired the ink dot from dot 1 at the top to dot 2112 at the bottom of the vertical line.

Cross-talk refers to undesirable fluidic interactions between neighboring nozzles. Certain aspects of the very high density nozzle layout illustrated in FIG. 6 increase cross-talk. First, nozzles 213 within a nozzle column 254 are disposed at a high density pitch, such as a 600 npi pitch, which places the nozzles 213 in closer proximity then in previous nozzle layout designs. In addition, the example printhead 240 is designed to operate at very high drop rate generation frequencies, such as up to 48 Khz in the embodiment having 2112 total nozzles in the printhead and up to 72 Khz in the embodiment having 1,216 total nozzles in the printhead. In these exemplary very high nozzle packing densities with a corresponding very high firing frequency, ink flux rate and ink refill rates are correspondingly very high. The ink feed slot 143/243 design illustrated in FIGS. 4, 5, and 6 provides high ink refill rates to the drop generators.

Conventional inkjet printheads only need to consider cross-talk between neighboring nozzles which are located in adjacent positions within a nozzle column, because nozzle columns are typically separated by sufficient distance such that nozzles in different nozzle columns do not interact fluidically. In the very high nozzle packing density of inkjet printhead 240, cross-talk potentially exists between neighboring nozzles, both within nozzle columns 254 as well as the nozzle column located on the opposite side of the adjacent ink feed slot 243 on the thin-film membrane 244. For example, nozzles 213 within nozzle columns 254*a* and 254*b* are considered neighboring nozzles from a cross-talk point of view, because these nozzles are both fed ink from left ink feed slot 243*a*. In addition, the nozzles 213 in nozzle columns 254*c* and 254*d* are considered neighboring nozzles from a cross-talk point of view, because these nozzles are both fed ink from right ink feed slot 243*b*.

A detailed discussion of certain cross-talk avoidance features which can be implemented in an example printhead 240 are discussed in detail in the above-incorporated Patent Application entitled "PRINTHEAD WITH HIGH NOZZLE PACKING DENSITY." One of the cross-talk avoidance features is the use of skip patterns in the address sequence order controlling the nozzle firing order of the inkjet printhead 240 so that adjacent nozzles are not fired consecutively to maximize the temporal separation of nozzle firings. In addition to this temporal improvement, fluidic isolation can be achieved by forming peninsulas extending between adjacent nozzles to further reduce cross-talk. Any suitable cross-talk reduction feature implemented in printhead 240 preferably does not substantially reduce lateral flow to the drop generators. Even though there is substantial ink flow along the length of the ink feed slots 243, printheads 240 having very high nozzle packing densities, such as 600 npi or greater, and operating at high frequencies, such as 18 Khz and higher, need to maintain sufficient lateral ink flow to produce the required very high refill rates.

One example suitable skip firing pattern is SKIP 4 where every fifth nozzle in a primitive is fired in sequence. For example, a sequence of SKIP 4 would produce a nozzle firing sequence in primitive 250*d* which fires every fifth nozzle to yield 1-21-41-13-33-5-25-45-17-37-9-29-1-21-etc.

The nozzle address is cycled through all M nozzle address values to control the nozzle firing order so that all nozzles can be fired, but only a single nozzle in a primitive is fired at a given time.

One example type of printhead includes an address generator and a hard-coded address decoder at each nozzle for controlling nozzle firing order. In this type of printhead, the nozzle firing sequence can only be modified by changing appropriate metal layers on the printhead die. Thus, if a new nozzle firing order is desired in this type of printhead, the set nozzle firing sequence is modified by changing one or more masks to thereby change the metal layers that determine the nozzle firing sequence.

In one embodiment, the nozzle firing order control by the nozzle address is programmable via printhead electronics having a programmable nozzle firing order controller which can be programmed to change the nozzle firing order in the printhead so that new masks do not need to be generated if a new firing order is desired. Such an inkjet printhead with a programmable nozzle firing order controller is described in detail in the above-incorporated Patent Application entitled "PROGRAMMABLE NOZZLE FIRING ORDER FOR INKJET PRINTHEAD ASSEMBLY."

Figure 7:
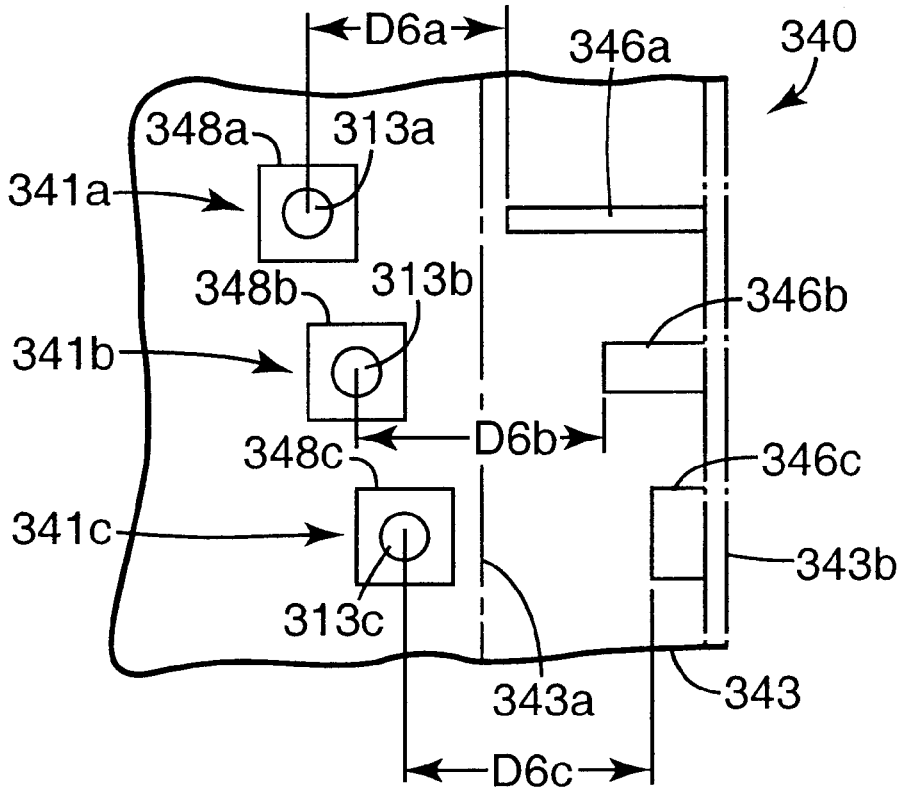
FIG. 7 is a simplified schematic top view of a portion of one embodiment of a printhead.

A simplified schematic top view diagram of a portion of a printhead 340 is illustrated generally in FIG. 7. The portion of the printhead 340 illustrated in FIG. 7 includes three drop generators 341*a*, 341*b*, and 341*c*. Drop generators 341*a*–341*c* respectively include nozzle 313*a* and resistor 348*a*, nozzle 313*b* and resistor 348*b*, and nozzle 313*c* and resistor 348*c*. A ink feed slot 343 having a inside edge 343*a* and an outside edge 343*b* provides a supply of liquid ink to drop generators 341*a*–341*c*. The portion of printhead 340 illustrated in FIG. 7 includes ink feed channels 346*a*, 346*b*, and 346*c* which communicate with ink feed slot 343. Drop generators 341*a*–341*c* are staggered with respect to a vertical axis to thereby have a varying distance from ink feed slot inside edge 343*a*. In the example embodiment illustrated in FIG. 7, drop generator 341*a* is located furthest from ink feed slot inside edge 343*a*, and drop generator 341*c* is located the closest to inside edge 343*a*.

The varying distances of drop generators 341*a*–341*c* from ink feed slot inside edge 343 a potentially create differences in ink flow from the corresponding ink feed channels 346*a*–346*c* to the respective drop generators 341*a*–341*c*. Ink feed channels 346*a*–346*c* have varying opening geometry to offset the varying distances from the respective drop generators 341*a*–341*c* to the ink feed slot inside edge 343*a*. In the simplified example embodiment illustrated in FIG. 7, drop generator 341*a* is located the furthest distance from ink feed slot inside edge 343*a* and is correspondingly fed ink via ink feed channel 346*a* having an opening geometry width extending perpendicular to the vertical axis away from ink feed slot outside edge 343*b* which is wider than the opening geometry widths of ink feed channels 346*b* and 346*c*. Drop generator 341*c* is located closest to ink feed slot inside edge 343*a* and is correspondingly fed ink via ink feed channel 346*c* having an opening geometry width extending perpendicular to the vertical axis away from ink feed slot outside edge 343*b* which is narrower than the opening geometry widths of ink feed channels 346*a* and 346*b*. Despite having varying opening geometry, ink feed channels 346*a*–346*c* preferably have substantially the same cross-sectional area to maintain a substantially constant fluidic pressure drop between ink feed slot 343 and the ink feed channels 346.

In one embodiment, to promote uniform refill rates for all the vaporization chambers of drop generators 341 in the vertically staggered drop generator design, such as illustrated in FIGS. 6 and 7, the distances, represented respectively by arrows D6*a*–*c* and referred to as the ink path length, from the leading edge of the ink feed channels 346*a*–346*c* to the center of the corresponding firing resistors 348*a*–348*c* or to the center of the corresponding nozzles 313*a*–313*c*, are substantially constant for all drop generators 341 on printhead 340. In one embodiment, the cross-sectional area of ink feed channels 346 and the ink path lengths represented by arrows D6 are both held constant for all ink feed channels in printhead 340.

In one example embodiment, such as illustrated in FIG. 7, the rear edges of ink feed channels 346*a*–346*c* have the same horizontal distance from ink feed slot outside edge 343*b* to improve manufacturability of ink feed channels 346. If ink feed channels 346 get to far away from the center of ink feed slot 343, etching used to form ink feed channels 346 washes out at a substantially lower rate potentially causing certain ink feed channels to never be opened.

The above-described design features of printhead 340 illustrated in FIG. 7 enable uniform refill rates for staggered, very high nozzle packing density designs, such as illustrated in FIG. 6.

Figure 8:
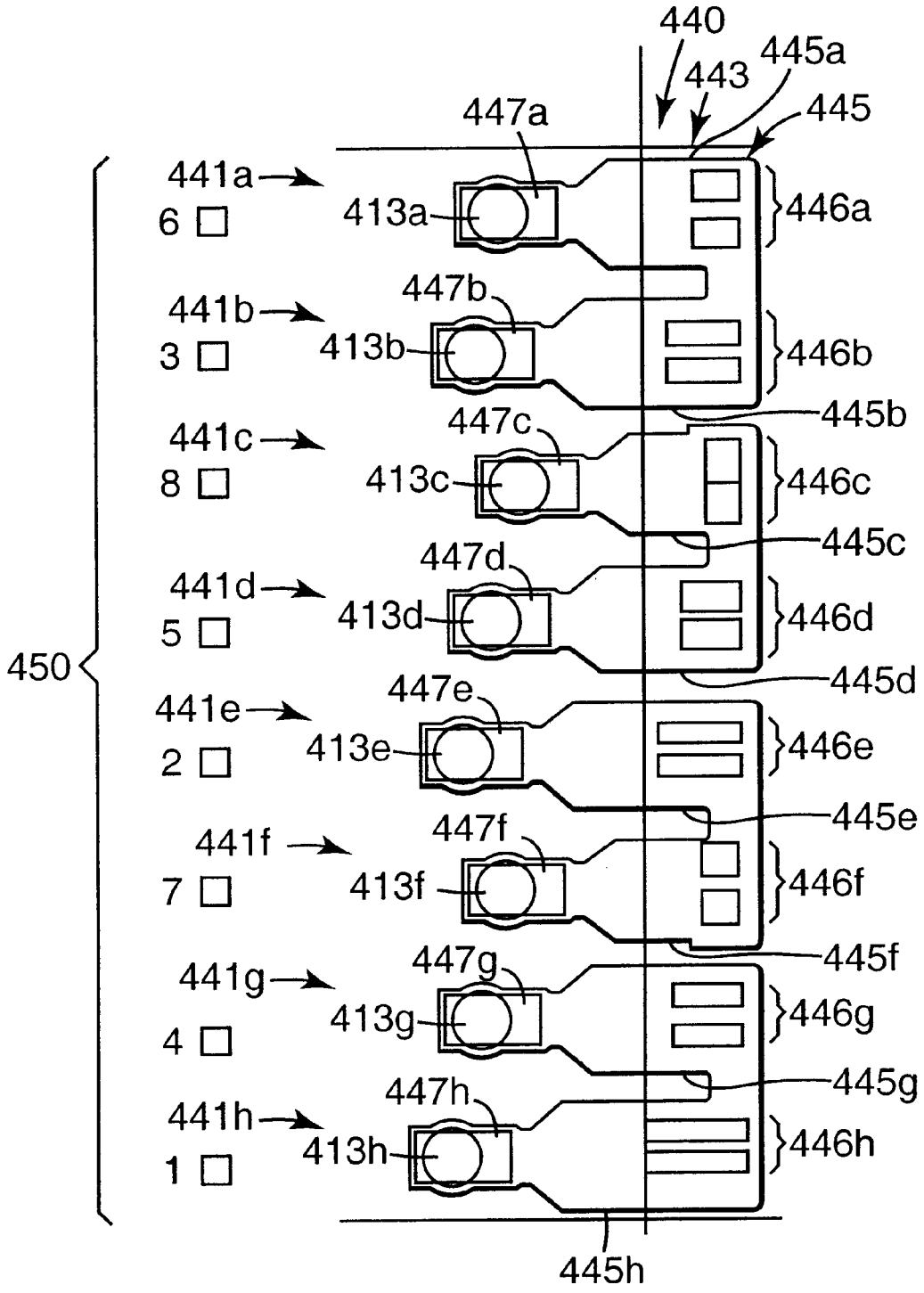
FIG. 8 is a simplified schematic top view of a portion of one embodiment of a printhead.

A portion of one embodiment of a printhead 440 is illustrated in a simplified schematic top view in FIG. 8. Printhead 440 includes a primitive 450 comprising eight drop generators 441*a*–441*h* having eight corresponding nozzles 413*a*–413*h*. In the illustrated embodiment of printhead 440, a SKIP 2 firing pattern, where every third nozzle 413 in primitive 450 is fired in sequence, is hard coded in address decoders, as indicated at each nozzle for controlling nozzle firing order. In this example embodiment, the firing sequence corresponding to nozzles 413*a*–413*h* is respectively 6,3,8,5,2,7,4, and 1 (i.e., the nozzles are fired in the following sequence 413*h*, 413*e*, 413*b*, 413*g*, 413*d*, 413*a*, 413*f*, and 413*c*). The firing sequence illustrated in FIG. 8 corresponds to a vertically staggered nozzle arrangement, wherein nozzles 413 are staggered progressively closer to an ink feed slot 443 in the order of the firing sequence such that nozzle 413*h* is the furthest from ink feed slot 443; nozzles 413*e*, 413*b*, 413*g*, 413*d*, 413*a*, and 413*f* are progressively closer to ink feed slot 443; and nozzle 413*c* is the closest to ink feed slot 443.

Pairs of ink feed channels 446*a*–446*h* correspond to nozzles 413*a*–413*h*. Nozzles 413 further away from ink feed slot 443 have corresponding ink feed channels 446 with greater widths. Ink feed channels 446 corresponding to nozzles 413 closer to ink feed slot 443 have progressively smaller widths, such as described above with reference to FIG. 7. Similar to the above description with reference to FIG. 7, each pair of ink feed channels 446 in printhead 440 preferably has the following parameters constant for all ink feed channels in printhead 440: the distance from the leading edge of the ink feed channel to the center of the nozzle (i.e., the ink path length); and the cross-sectional area of the ink feed channel.

In the embodiment illustrated in FIG. 8, printhead 440 includes orifice or barrier layer 445, which is constructed to group drop generators 441*a*–441*h* into pairs of drop generators which share ink feed paths, but are fluidically isolated on the top of the printhead substrate from the rest of the drop generators 441. For example, in primitive 450, drop generators 441*a* and 441*b* are grouped into a first sub-group which share ink feed channels 446*a* and 446*b*. A vaporization chamber 447*a* is fluidically coupled to an ink feed path 445*a* formed in orifice layer 445 which is fluidically coupled to ink feed slot 443 via the pair of ink feed channels 446*a*. Similarly, a vaporization chamber 447*b* is fluidically coupled to an ink feed path 445*b* formed in orifice layer 445 which is fluidically coupled to ink feed slot 443 via the pair of ink feed channels 446*b*. Ink feed paths 445*a* and 445*b* are also fluidically coupled together, but fluidically isolated from other ink feed paths 445*c*–445*h* and their corresponding vaporization chambers 447*c*–447*h*. Similarly, vaporization chambers 447*c* and 447*d* are respectively fluidically coupled to ink feed paths 445*c* and 445*d*, which are fluidically coupled together, but fluidically isolated from other ink feed paths 445*a*–445*b* and 445*e*–445*h*. Vaporization chambers 447*e* and 447*f* are respectively fluidically coupled to ink feed paths 445*e* and 445*f*, which are fluidically coupled together, but fluidically isolated from other ink feed paths 445*a*–445*d* and 445*g*–445*h*. Vaporization chambers 447*g* and 447*h* are respectively fluidically coupled to ink feed paths 445*g* and 445*h*, which are fluidically coupled together, but fluidically isolated from other ink feed paths 445.

The grouping of fluidically isolated sub-groups of drop generators 441 is accomplished in an example embodiment by forming a sub-surface cavity in orifice layer 445 over the thin film layer (not shown in FIG. 8) so that a sidewall defining the sub-surface cavity encompasses the sub-group of nozzles and shared ink feed channels. The sidewall formed in the orifice layer 445 has a perimeter which extends around the drop generators 441 and the ink feed channels 446 of the given sub-group. In this way, the nozzles of each sub-group are fluidically isolated from nozzles of other sub-groups on the top of the substrate (not shown in FIG. 8) of printhead 440, yet are commonly fluidically coupled to the ink feed slot 443 on the bottom of the substrate.

In the embodiment illustrated in FIG. 8, each nozzle 413 is fed ink from its corresponding pair of ink feed channels 446 and is also potentially fed ink from the pair of ink feed channels 446 corresponding to the other nozzle 413 in the given sub-group. In this way, the fluidically coupled nozzles 413 provide a degree of particle tolerance, because ink feed channels 446 associated with a particular nozzle can be blocked, yet refill of ink is sustained or supplemented by pulling ink from neighboring ink feed channels, allowing the nozzle to continue operation.

The sub-groups of orifice layer 445 fluidically coupled drop generators 441 are arranged in pairs in the embodiment of printhead 440 illustrated in FIG. 8. In other embodiments, drop generators are grouped in three's, four's, and even larger sub-groups. In some embodiments, all of the sub-groups do not have the same number of nozzles.

Another advantage of configuring drop generators 441 in sub-groups is that cross-talk can be substantially reduced in high nozzle packing density printheads, such as illustrated in FIG. 6. Since the only connection between non-grouped nozzles 413 outside a particular sub-grouping is through ink feed slot 443, the potential for fluidic interaction with nozzles outside a particular sub-group is minimized. Cross-talk between nozzles 413 in any particular sub-group is minimized by utilizing a skip firing pattern in which drop generators 441 within a sub-group never fire sequentially (e.g., the SKIP 2 firing pattern illustrated in FIG. 8 never causes nozzles within a sub-group to fire sequentially).

Some embodiments of printheads according to the present invention optimize connection of ink feed paths by selecting a number of connected vaporization chambers as a function of a vertical stagger pattern. For example, in a SKIP 0 firing pattern, wherein each nozzle in the primitive is fired in sequential order (i.e., 1-2-3-4-5-6-7-8-1-2-etc.), resulting in adjacent nozzles firing consecutively, an isolated vaporization chamber is desirable to reduce cross-talk by fluidically isolating neighboring nozzles which fire sequentially. In one optimization technique, refill performance and particle tolerance can be maximized for a design by coupling the ink feed paths of as many nozzles as possible without connecting nozzles that fire sequentially. For printhead configurations with uniform skip patterns, the maximum number of connected nozzles is equal to the number of nozzles skipped between sequential firings plus one. For example, for a SKIP 0 firing pattern, the maximum number of connected ink feed paths is one; for a SKIP 2 firing pattern, the maximum number of connected ink feed paths is three; and for a SKIP 4 firing pattern, the maximum number of connected ink feed paths is five.

For printhead configurations with non-uniform skip patterns, the above optimization technique for uniform skip patterns of fluidically isolating sequentially firing nozzles while maximizing sharing of ink feed paths is employed, but is more complicated to implement, because the number of nozzles sharing ink feed paths needs to be reduced in some locations.

As illustrated in FIGS. 2, 4, and 5 ink feed channels 46 and 146 are respectively defined entirely by thin-film layers 44 and 144. In these embodiments, ink feed channels 46/146 are formed by etching (e.g., plasma etching) through thin-film layers 44/144. In one example embodiment, a single ink feed channel mask is employed and in another embodiment several masking and etching steps are employed to form the various thin-film layers.

In these embodiments where ink feed channels 46/146 are entirely defined by thin-film layers 44/144, the ink feed channels are formed by a thin-film patterning process which provides the capability for forming small and very accurately placed ink feed channels. These small and very accurately placed ink feed channels 46/146 being defined in the thin-film layers 44/144 allows for precise tuning of hydraulic diameters of the ink feed channels and distances from the ink feed channels to the associated firing resistors 48/148. The hydraulic diameter of an ink feed channel is herein defined as the ratio of the cross-sectional area of the ink feed channel opening to its wetted perimeter defined by the wall of the ink feed channel. Forming ink feed channels by etching through silicon, such as used to form silicon substrate 42/142, does not provide such accurately formed and accurately placed ink feed channels.

A portion of one embodiment of a printhead 540 is illustrated schematically in FIGS. 9–11, wherein FIG. 9 is a top view, FIG. 10 is a cross-sectional side view taken along lines 10—10 from FIG. 9, and FIG. 11 is a bottom view of printhead 540. Printhead 540 includes a drop ejection element or drop generator 541. Drop generator 541 is formed on a substrate 542 which has an ink feed slot 543 formed therein. Ink feed slot 543 provides a supply of ink to drop generators 541. Printhead 540 includes a thin-film structure 544 on top of substrate 542. Printhead 540 includes an orifice layer 545 on top of thin-film structure 544 and substrate 542.

Each drop generator 541 includes a nozzle 513, a vaporization chamber 547, and a firing resistor 548.

Thin-film structure 544 has an ink feed channel thin-film wall 544*a* formed therein which defines a first portion of an ink feed channel 546. Orifice layer 545 has nozzles 513 formed therein. Orifice layer 545 has vaporization chamber 547 formed therein and defined by vaporization chamber orifice layer walls 545*a*. Vaporization chamber 547 communicates with nozzles 513 and ink feed channel 546. Orifice layer 545 includes ink feed channel orifice layer walls 545*b* which define a second portion of ink feed channel 546 not defined by ink feed channel thin-film wall 544*a*. The ink feed channel 546 formed with thin-film structure 544 and orifice layer 545 and defined by ink feed channel thin-film wall 544*a* and ink feed channel orifice layer walls 545*b* communicates with ink feed slot 543 formed in substrate 542.

Firing resistor 548 is positioned within vaporization chamber 547. Leads 549 electrically couple firing resistor 548 to circuitry controlling the application of electrical current through selected firing resistors. During printing, ink flows from ink feed slot 543 to vaporization chamber 547 via ink feed channel 546 formed with thin-film structure 544 and orifice layer 545. Each nozzle 513 is operatively associated with a corresponding firing resistor 548, such that droplets of ink within vaporization chamber 547 are ejected through the selected nozzle 513 (e.g., normal to the plane of the corresponding firing resistor 548) and toward a print medium upon energization of the selected firing resistor 548.

Thin-film structure 544 is also herein referred to as a thin-film membrane 544. Thus, the ink feed channel 546 is referred to as a partial membrane defined ink feed channel, because ink feed channel 546 is defined by the thin-film membrane 544 and the orifice layer 545. In one embodiment, orifice layer 545 is fabricated using a spun-on epoxy referred to as SU8, marketed by Micor-Chem, Newton, Mass. When orifice layer 545 is formed from SU8 or similar polymers, the ink feed channel 546 formed from thin-film membrane 544 and orifice layer 545 can provide the capability of forming even smaller and even more accurately placed ink feed channels than possible by forming ink feed channels entirely by a thin-film patterning process, such as described above for the ink feed channels 46 and 146 respectively defined entirely by thin-film layers 44 and 144 and illustrated in FIGS. 2, 4, and 5. These even smaller and more accurately placed ink feed channels 546 being defined in the partial thin-film membrane 544 and the SU8 or other polymer orifice layer 545 allow for even more precise tuning of hydraulic diameters of the ink feed channels 546 and the distances from the ink feed channels to the associated firing resistors 548.

The above-described very high nozzle packing densities and the printhead electronics described in the above-incorporated Patent Application entitled "INKJET PRINTHEAD ASSEMBLY HAVING VERY HIGH DROP RATE GENERATION" enable a high-drop generator count printhead with at least 400 drop generators and a primitive to address ratio of at least 10 to 1. A primitive to address ratio of at least 10 to 1 enables operating frequencies of at least 20 Khz with the ability to generate at least 20 million drops of ink per second.

In the exemplary embodiment of printhead 240 illustrated in FIG. 6, printhead 240 includes 2112 drop generators and can operate up to 48 Khz. In another example embodiment, printhead 240 includes 1216 drop generators and can operate up to a frequency of 72 Khz. In the 2112 drop generator embodiment, operating at up to approximately 48 Khz, there are 176 primitives and 12 address values yielding a primitive to address ratio of approximately 14.7 for a total of 188 combined count of primitives and addresses. In the 1216 drop generator embodiment, operating up to approximately 72 Khz, there are 152 primitives and eight address values yielding a primitive to address ratio of approximately 19 to 1 for a total of 160 combined count of primitives and addresses.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printhead comprising:

a substrate having an ink feed slot formed in and completely through the substrate, the ink feed slot defining an opening in the substrate, wherein the ink feed slot has a first side and second side along a vertical length of the ink feed slot;

drop generators, each drop generator having a nozzle and a vaporization chamber, wherein a first column of drop generators are formed along the first side of the ink feed slot, and a second column of drop generators are formed along the second side of the ink feed slot;

ink feed channels, wherein at least one ink feed channel is fluidically coupled to each vaporization chamber and is fluidically coupled to the ink feed slot, wherein the ink feed slot has an inside edge, the first columns of drop generators have varying distances from the inside edge, and the ink feed channels have varying opening geometries to offset the varying distances;

a thin-film structure supported by the substrate and having ink feed channel thin-film walls, each ink feed channel thin-film wall extending past the opening in the substrate and defining a first portion of a corresponding ink feed channel, which extends from the ink feed slot to a corresponding vaporization chamber; and an orifice layer supported by the substrate, defining the nozzles and the vaporization chambers in the drop generators, and having ink feed channel orifice layer walls, each ink feed channel orifice layer wall extending past the opening in the substrate and defining a second portion of the corresponding ink feed channel, which extends from the ink feed slot to the corresponding vaporization chamber.

2. The inkjet printhead of claim 1 wherein the orifice layer comprises a polymer.

3. The inkjet printhead of claim 1 wherein the orifice layer comprises SU8.

4. The inkjet printhead of claim 1 wherein each drop generator includes a firing resister formed in the thin-film structure.

5. The inkjet printhead of claim 1 further comprising:

a second ink feed slot formed in the substrate, wherein the second ink feed slot has a first side and second side along a vertical length of the second ink feed slot;

a third column of drop generators formed along the first side of the second ink feed slot; and a fourth column of drop generators formed along the second side of the second ink feed slot.

6. The inkjet printhead of claim 5 wherein nozzles within the first and second columns of drop generators are vertically offset from nozzles within the third and fourth columns of drop generators.

7. The inkjet printhead of claim 1 wherein nozzles within the first column of drop generators are vertically offset from nozzles within the second column of drop generators.

8. The inkjet printhead of claim 1 wherein the ink feed channels have substantially constant cross-sectional areas.

9. The inkjet printhead of claim 1 wherein the ink feed channels each include a leading edge and a distance from the leading edge to a center of a corresponding nozzle is substantially constant for each of the drop generators.

10. An inkjet printhead comprising:

a substrate having an ink feed slot formed in and completely through the substrate, the ink feed slot defining an opening in the substrate;

drop generators, each drop generator having a nozzle and a vaporization chamber;

ink feed channels, wherein at least one ink feed channel is fluidically coupled to each vaporization chamber and is fluidically coupled to the ink feed slot;

a thin-film structure supported by the substrate and having ink feed channel thin-film walls, each ink feed channel thin-film wall extending past the opening in the substrate and defining a first portion of a corresponding ink feed channel, which extends from the ink feed slot to a corresponding vaporization chamber; and an orifice layer supported by the substrate, defining the nozzles and the vaporization chambers in the drop generators, and having ink feed channel orifice layer walls, each ink feed channel orifice layer wall extending past the opening in the substrate and defining a second portion of the corresponding ink feed channel, which extends from the ink feed slot to the corresponding vaporization chamber, wherein a first column of drop generators is arranged in subgroups, wherein the orifice layer fluidically isolates each subgroup from other subgroups on a top of the substrate but the subgroups are commonly fluidically coupled to the ink feed slot on a bottom of the substrate.

11. The inkjet printhead of claim 10 wherein the ink feed slot has a first side and second side along a vertical length of the ink feed slot, wherein a first column of drop generators are formed along the first side of the ink feed slot, and a second column of drop generators are formed along the second side of the ink feed slot.

12. The inkjet printhead of claim 11 further comprising:

a second ink feed slot formed in the substrate, wherein the second ink feed slot has a first side and second side along a vertical length of the second ink feed slot;

a third column of drop generators formed along the first side of the second ink feed slot; and a fourth column of drop generators formed along the second side of the second ink feed slot.

13. The inkjet printhead of claim 12 wherein nozzles within the first and second columns of drop generators are vertically offset from nozzles within the third and fourth columns of drop generators.

14. The inkjet printhead of claim 11 wherein nozzles within the first column of drop generators are vertically offset from nozzles within the second column of drop generators.

15. The inkjet printhead of claim 11 wherein the nozzles within each column of drop generators are staggered horizontally along a scan axis.

16. The inkjet printhead of claim 11 wherein the ink feed slot has an inside edge, the first columns of drop generators have varying distances from the inside edge, and the ink feed channels have varying opening geometries to offset the varying distances.

17. The inkjet printhead of claim 16 wherein the ink feed channels have substantially constant cross-sectional areas.

18. The inkjet printhead of claim 16 wherein the ink feed channels each include a leading edge and a distance from the leading edge to a center of a corresponding nozzle is substantially constant for each of the drop generators.

19. The inkjet printhead of claim 10 wherein the subgroups are arranged to minimize fluidic cross-talk between nozzles.

20. The inkjet printhead of claim 10 wherein the orifice layer comprises a polymer.

21. The inkjet printhead of claim 10 wherein the orifice layer comprises SU8.

22. The inkjet printhead of claim 10 wherein each drop generator includes a firing resister formed in the thin-film structure.

23. An inkjet printhead assembly comprising:

at least one printhead including:

a substrate having an ink feed slot formed in the substrate, the ink feed slot defining an opening in and completely through the substrate, wherein the ink feed slot has a first side and second side along a vertical length of the ink feed slot;

drop generators, each drop generator having a nozzle and a vaporization chamber, wherein a first column of drop generators are formed along the first side of the ink feed slot, and a second column of drop generators are formed along the second side of the ink feed slot;

ink feed channels, wherein at least one ink feed channel is fluidically coupled to each vaporization chamber and is fluidically coupled to the ink feed slot, wherein the ink feed slot has an inside edge, the first columns of drop generators have varying distances from the inside edge, and the ink feed channels have varying opening geometries to offset the varying distances;

a thin-film structure supported by the substrate and having ink feed channel thin-film walls, each ink feed channel thin-film wall extending past the opening in the substrate and defining a first portion of a corresponding ink feed channel, which extends from the ink feed slot to a corresponding vaporization chamber; and an orifice layer supported by the substrate, defining the nozzles and the vaporization chambers in the drop generators, and having ink feed channel orifice layer walls, each ink feed channel orifice layer wall extending past the opening in the substrate and defining a second portion of the corresponding ink feed channel, which extends from the ink feed slot to the corresponding vaporization chamber.

24. The inkjet printhead assembly of claim 23 wherein the inkjet printhead assembly includes multiple printheads.

25. A fluid ejection device comprising:

a substrate having a fluid feed slot formed in and completely through the substrate, the fluid feed slot defining an opening in the substrate, wherein the fluid feed slot has a first side and second side along a vertical length of the fluid feed slot;

drop generators, each drop generator having a nozzle and a vaporization chamber, wherein a first column of drop generators are formed along the first side of the fluid feed slot, and a second column of drop generators are formed along the second side of the fluid feed slot;

fluid feed channels, wherein at least one fluid feed channel is fluidically coupled to each vaporization chamber and is fluidically coupled to the fluid feed slot, wherein the fluid feed slot has an inside edge, the first columns of drop generators have varying distances from the inside edge, and the fluid feed channels have varying opening geometries to offset the varying distances;

a thin-film structure supported by the substrate and having fluid feed channel thin-film walls, each fluid feed channel thin-film wall extending past the opening in the substrate and defining a first portion of a corresponding fluid feed channel, which extends from the fluid feed slot to a corresponding vaporization chamber; and an orifice layer supported by the substrate, defining the nozzles and the vaporization chambers in the drop generators, and having fluid feed channel orifice layer walls, each fluid feed channel orifice layer wall extending past the opening in the substrate and defining a second portion of the corresponding fluid feed channel, which extends from the fluid feed slot to the corresponding vaporization chamber.

26. The fluid ejection device of claim 25 wherein the orifice layer comprises a polymer.

27. The fluid ejection device of claim 25 wherein the orifice layer comprises SU8.

28. The fluid ejection device of claim 25 wherein each drop generator includes a firing resister formed in the thin-film structure.

29. The fluid ejection device of claim 25 further comprising:

a second fluid feed slot formed in the substrate, wherein the second fluid feed slot has a first side and second side along a vertical length of the second fluid feed slot;

a third column of drop generators formed along the first side of the second fluid feed slot; and a fourth column of drop generators formed along the second side of the second fluid feed slot.

30. The fluid ejection device of claim 29 wherein nozzles within the first and second columns of drop generators are vertically offset from nozzles within the third and fourth columns of drop generators.

31. The fluid ejection device of claim 25 wherein nozzles within the first column of drop generators are vertically offset from nozzles within the second column of drop generators.

32. The fluid ejection device of claim 25 wherein the nozzles within each column of drop generators are staggered horizontally along a scan axis.

33. The fluid ejection device of claim 25 wherein the fluid feed channels have substantially constant cross-sectional areas.

34. The fluid ejection device of claim 25 wherein the fluid feed channels each include a leading edge and a distance from the leading edge to a center of a corresponding nozzle is substantially constant for each of the drop generators.

35. A fluid ejection device of comprising:

a substrate having a fluid feed slot formed in and completely through the substrate, the fluid feed slot defining an opening in the substrate;

drop generators, each drop generator having a nozzle and a vaporization chamber;

fluid feed channels, wherein at least one fluid feed channel is fluidically coupled to each vaporization chamber and is fluidically coupled to the fluid feed slot;

a thin-film structure supported by the substrate and having fluid feed channel thin-film walls, each fluid feed channel thin-film wall extending past the opening in the substrate and defining a first portion of a corresponding fluid feed channel, which extends from the fluid feed slot to a corresponding vaporization chamber; and an orifice layer supported by the substrate, defining the nozzles and the vaporization chambers in the drop generators, and having fluid feed channel orifice layer walls, each fluid feed channel orifice layer wall extending past the opening in the substrate and defining a second portion of the corresponding fluid feed channel, which extends from the fluid feed slot to the corresponding vaporization chamber, wherein the first column of drop generators is arranged in subgroups, wherein the orifice layer fluidically isolates each subgroup from other subgroups on a top of the substrate but the subgroups are commonly fluidically coupled to the fluid feed slot on a bottom of the substrate.

36. The fluid ejection device of claim 35 wherein the fluid feed slot has a first side and second side along a vertical length of the fluid feed slot, wherein a first column of drop generators are formed along the first side of the fluid feed slot, and a second column of drop generators are formed along the second side of the fluid feed slot.

37. The fluid ejection device of claim 36 wherein the fluid feed slot has an inside edge, the first columns of drop generators have varying distances from the inside edge, and the fluid feed channels have varying opening geometries to offset the varying distances.

38. The fluid ejection device of claim 35 wherein the subgroups are arranged to minimize fluidic cross-talk between nozzles.

39. A method of operating an inkjet printhead comprising:

carrying ink in an ink feed slot formed in a substrate, wherein the ink feed slot defines an opening in and completely through the substrate;

ejecting ink from drop generators by vaporizing ink in corresponding vaporization chambers in the drop generators and ejecting ink from the corresponding vaporization chambers via corresponding nozzles in the drop generators;

arranging a first column of drop generators into subgroups;

carrying ink from the ink feed slot to the corresponding vaporization chambers with corresponding ink feed channels, wherein a thin-film structure supported by the substrate includes corresponding ink feed channel thin-film walls which extend past the opening in the substrate and define corresponding first portions of the corresponding ink feed channels, which extends from the ink feed slot to corresponding vaporization chambers, and wherein an orifice layer supported by the substrate defines the corresponding nozzles and the corresponding vaporization chambers in the drop generators and includes corresponding ink feed channel orifice layer walls which extend past the opening in the substrate and define corresponding second portions of the corresponding ink feed channels, which extends from the ink feed slot to the corresponding vaporization chambers;

fluidically isolating, with the orifice layer, each subgroup from other subgroups on a top of the substrate; and commonly fluidically coupling the subgroups to the ink feed slots on a bottom of the substrate.

40. The method of claim 39 wherein the orifice layer comprises a polymer.

41. The method of claim 40 wherein the orifice layer comprises SU8.

* * * * *